US009685126B2

(12) United States Patent
Lim

(10) Patent No.: US 9,685,126 B2
(45) Date of Patent: Jun. 20, 2017

(54) DEVICE AND METHOD FOR TUNING COLOR TEMPERATURE IN DIGITAL DISPLAY DEVICE

(75) Inventor: Kyong-Ho Lim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 602 days.

(21) Appl. No.: 13/184,878

(22) Filed: Jul. 18, 2011

(65) Prior Publication Data

US 2012/0147061 A1 Jun. 14, 2012

(30) Foreign Application Priority Data

Dec. 10, 2010 (KR) ..... 10-2010-0126254

(51) Int. Cl.

| | |
|---|---|
| ***G09G 3/00*** | (2006.01) |
| ***G09G 3/36*** | (2006.01) |
| *G09G 3/3208* | (2016.01) |

(52) U.S. Cl.

CPC ..... *G09G 3/3611* (2013.01); *G09G 3/3208* (2013.01); *G09G 2320/0242* (2013.01); *G09G 2320/0666* (2013.01); *G09G 2320/0673* (2013.01); *G09G 2320/0693* (2013.01); *G09G 2360/145* (2013.01)

(58) Field of Classification Search

CPC ... G09G 2320/0673; G09G 2320/0693; G09G 2360/145

USPC ..... 345/690, 257, 55

See application file for complete search history.

(56) References Cited

U.S. PATENT DOCUMENTS

| | | | | |
|---|---|---|---|---|
| 6,611,249 | B1 | 8/2003 | Evanicky et al. | |
| 2002/0015044 | A1* | 2/2002 | Edge | G06T 11/001 345/600 |
| 2005/0057473 | A1* | 3/2005 | Hsu | G09G 3/3611 345/89 |
| 2005/0270383 | A1* | 12/2005 | Hung | 348/225.1 |
| 2007/0052735 | A1* | 3/2007 | Chou | 345/690 |
| 2007/0285576 | A1* | 12/2007 | Moore et al. | 348/674 |
| 2012/0063675 | A1* | 3/2012 | Dittert et al. | 382/162 |

FOREIGN PATENT DOCUMENTS

| | | | |
|---|---|---|---|
| CN | 1741122 | A | 3/2006 |
| CN | 101447161 | A | 6/2009 |
| CN | 101860764 | A | 10/2010 |

* cited by examiner

*Primary Examiner* — William Boddie
*Assistant Examiner* — Leonid Shapiro
(74) *Attorney, Agent, or Firm* — Dentons US LLP

(57) ABSTRACT

The present invention relates to method and device for tuning a color temperature in a digital display device, in which variation of color temperatures and color feelings between gradients is reduced for improving a picture quality.

8 Claims, 10 Drawing Sheets

DEVICE AND METHOD FOR TUNING COLOR TEMPERATURE IN DIGITAL DISPLAY DEVICE

CROSS REFERENCE TO RELATED APPLICATION

This application claims the benefit of Korean Patent Application No. 10-2010-0126254, filed on Dec. 10, 2010, which is hereby incorporated by reference as if fully set forth herein.

BACKGROUND OF THE DISCLOSURE

Field of the Disclosure

The present invention relates to digital display devices, and more particularly to method and device for tuning a color temperature in a digital display device, in which variation of color temperatures and color feelings between gradients is reduced for improving a picture quality.

Discussion of the Related Art

Currently, as the digital display device, a liquid crystal display device LCD or an organic light emitting diode OLED display device is used, mostly.

The liquid crystal display device displays an image by using electric and optical characteristics of liquid crystals having anisotropy in refractive index and dielectric, wherein each of pixels of a pixel matrix produces a gradation by controlling transmissivity of a light transmitting a polarizing plate by varying orientation of the liquid crystals in response to a data signal.

The organic light emitting diode display device, a spontaneous emissive device which makes an organic luminescence layer to emit a light by re-combination of an electron and a hole, has advantages in that brightness is high, a driving voltage is low, and production of very thin device is possible. The organic light emitting diode display device produces the gradient as a pixel driving circuit controls intensity of a current being supplied to the organic light emitting diode in response to the data signal.

In general, a standard color temperature of the digital display device is set to be 6500K±500K, and a user can maintain the same color feeling only when the color temperature of each gradient is consistent. However, since a related art liquid crystal display device has a great variation of the color temperatures between the gradients, the liquid crystal display device has a problem in that a picture quality becomes poor due to a color feeling difference between the gradients.

Referring to FIG. 1, it can be known that the related art liquid crystal display device has a variation of color temperatures between the gradients in a range of ±2700K with reference to a reference color temperature of 6500K. The higher the color temperature with reference to 6500K, white appears bluish, and the lower the color temperature with reference to 6500K, white appears reddish. The related art liquid crystal display device has a problem in that the great variation of color feeling between the gradients caused by the color temperature variation makes the picture quality poor.

In order to solve this problem, in the related art liquid crystal display device, a designer tunes a digital gamma algorithm DGA of each of red, green and blue to tune the color temperature. However, since the related art color temperature tuning depends on a designer's sense, the related art color temperature tuning has problems in that, not only quantitative evaluation is difficulty, a long time period is required for dealing with a buyer's standard, but also reduction of the color temperature variation to be below ±2400K with reference to 6500K is difficult even if the color temperature tuning is made.

The problems caused by the variation of color temperatures between the gradients takes place not only to the liquid crystal display device, but also to the organic light emitting diode display device.

SUMMARY OF THE DISCLOSURE

Accordingly, the present invention is directed to method and device for tuning a color temperature in a digital display device.

An object of the present invention is to provide method and device for tuning a color temperature in a digital display device, in which variation of color temperatures and color feelings between gradients is reduced for improving a picture quality.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for tuning a color temperature in a liquid crystal display device includes the steps of, while tuning a blue gamma at a gamma look-up table having red, green and blue gammas stored in the liquid crystal display device, determining whether a color temperature measured from the liquid crystal display device having the blue gamma tuned thus applied thereto meets a preset color temperature range or not, to keep tuning the blue gamma until the color temperature range is met, if the measured color temperature meets the first color temperature range in the blue gamma tuning step, while tuning the red gamma, determining whether a color temperature variation measured from the liquid crystal display device having the red gamma tuned thus applied thereto meets a preset first color temperature variation range or not, to keep tuning the red gamma until the first color temperature variation range is met, if the color temperature variation range detected in the red gamma tuning step meets the first color temperature variation range, determining whether the color temperature variation measured from the liquid crystal display device having the red gamma tuned thus applied thereto meets a preset second color temperature variation range or not, to keep repeating tuning of the red gamma and the red gamma until the second color temperature variation range is met, and finishing the blue and red gamma tuning if the second color temperature variation range is met in above step, and storing a final gamma look-up table having the blue gamma and the red gamma tuned thus and the green gamma at the liquid crystal display device.

The method further includes the step of measuring a color feeling difference of the liquid crystal display device, and determining whether the color feeling difference measured thus meets a preset color feeling difference range or not if the color temperature variation range detected thus meets the second color temperature variation range, and repeating tuning the blue gamma and the red gamma tuning until the color feeling difference range is met.

The step of determining whether the color temperature variation measured from the liquid crystal display device having the red gamma tuned thus applied thereto meets a preset second color temperature variation range includes the step of determining whether a difference between a Y stimulus value function f(Y) value and an X stimulus value function f(X) which is detected from the measured data from the liquid crystal display device is below 0.8% or not.

The step of determining whether the color temperature variation measured from the liquid crystal display device having the red gamma tuned thus applied thereto meets a preset second color temperature variation range includes the step of determining whether a difference between a Y stimulus value function f(Y) value and an Z stimulus value function f(Z) which is detected from the measured data from the liquid crystal display device is below 1.5% or not.

The step of determining whether the color feeling difference measured thus meets a preset color feeling difference range or not if the color temperature variation range detected thus meets the second color temperature variation range includes the step of determining the color feeling difference $\Delta a^*$ or $\Delta b^*$ measured thus is within a range of −3.0~3.0.

In another aspect of the present invention, a device for tuning a color temperature in a digital image display device includes a liquid crystal display device for displaying a measuring pattern from an outside by using a gamma look-up table having red, green, and blue gammas stored in a memory in the liquid crystal display device, a measuring system for taking a photograph of the measuring pattern displayed on the liquid crystal display device and extracting a measured data, and a host computer for, while reading the look-up table from the liquid crystal display device and tuning the blue gamma and the red gamma, controlling the liquid crystal display device to display the measured pattern by using the gamma tuned thus, detecting a color temperature and a color feeling difference of the liquid crystal display device by using the measured data extracted from the measuring system, determining whether the color temperature and the color feeling difference detected thus meets a preset range or not, finishing the gamma tuning if the range is met, and storing a final gamma look-up table having the blue and red gammas tuned thus and the green gamma in the liquid crystal display device.

The host computer, while tuning a blue gamma at a gamma look-up table, determines whether a color temperature measured from the liquid crystal display device having the blue gamma tuned thus applied thereto meets a preset color temperature range or not, to keep tuning the blue gamma until the color temperature range is met, if the measured color temperature meets the first color temperature range, while tuning the red gamma, determines whether a color temperature variation measured from the liquid crystal display device having the red gamma tuned thus applied thereto meets a preset first color temperature variation range or not, to keep tuning the red gamma until the first color temperature variation range is met, if the first color temperature variation range is met, determines whether the color temperature variation measured from the liquid crystal display device having the red gamma tuned thus applied thereto meets a preset second color temperature variation range or not, to keep repeating tuning of the red gamma and the red gamma until the second color temperature variation range is met, and finishes the blue and red gamma tuning if the second color temperature variation range is met.

The host computer measures a color feeling difference of the liquid crystal display device, and determines whether the color feeling difference measured thus meets a preset color feeling difference range or not, if the color temperature variation range detected thus meets the second color temperature variation range, and repeats tuning the blue gamma and the red gamma tuning until the color feeling difference range is met, additionally.

The host computer determines whether a difference between a Y stimulus value function f(Y) value and an X stimulus value function f(X) which is detected from the measured data from the liquid crystal display device is below 0.8% or not at the time it is determined whether the color temperature variation measured from the liquid crystal display device having the red gamma tuned thus applied thereto meets a preset second color temperature variation range or not.

The host computer determines whether a difference between a Y stimulus value function f(Y) value and an Z stimulus value function f(Z) which is detected from the measured data from the liquid crystal display device is below 1.5% or not at the time it is determined whether the color temperature variation measured from the liquid crystal display device having the red gamma tuned thus applied thereto meets a preset second color temperature variation range.

The host computer determines the color feeling difference $\Delta a^*$ or $\Delta b^*$ measured thus is within a range of −3.0~3.0 at the time it is determined whether the color feeling difference measured thus meets a preset color feeling difference range or not if the color temperature variation range detected thus meets the second color temperature variation range.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Before describing the embodiments of the present invention, causes of color temperature variation and color feeling difference between gradients taken place in the related art liquid crystal display device will be reviewed in advance.

Figure 1:
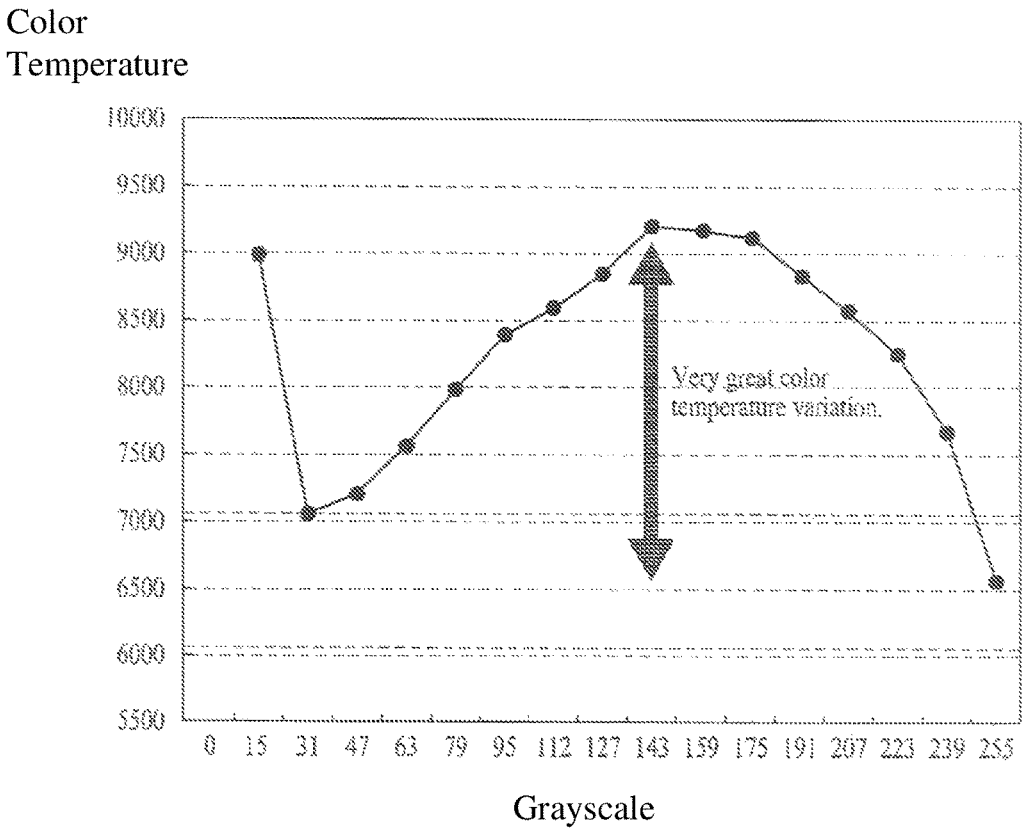
FIG. 1 illustrates a graph showing a color temperature of each gradient in a related art liquid crystal display device.
Figure 2A:
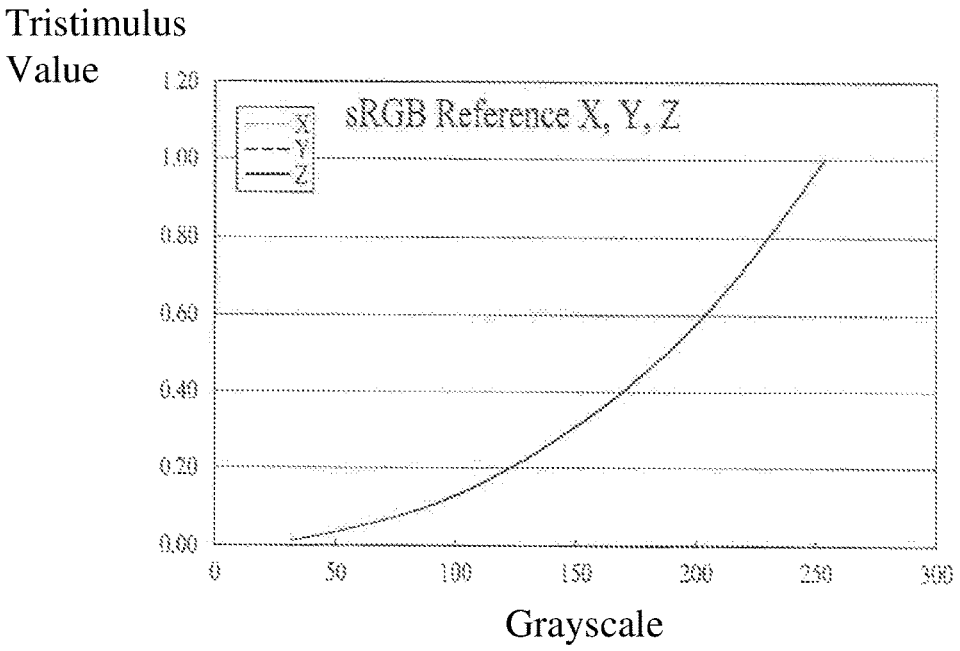
FIGS. 2A and 2B illustrate comparative graphs showing tristimulus values on a gradient of a standard image, and tristimulus values on a gradient measured in a related art liquid crystal display device.
Figure 2B:
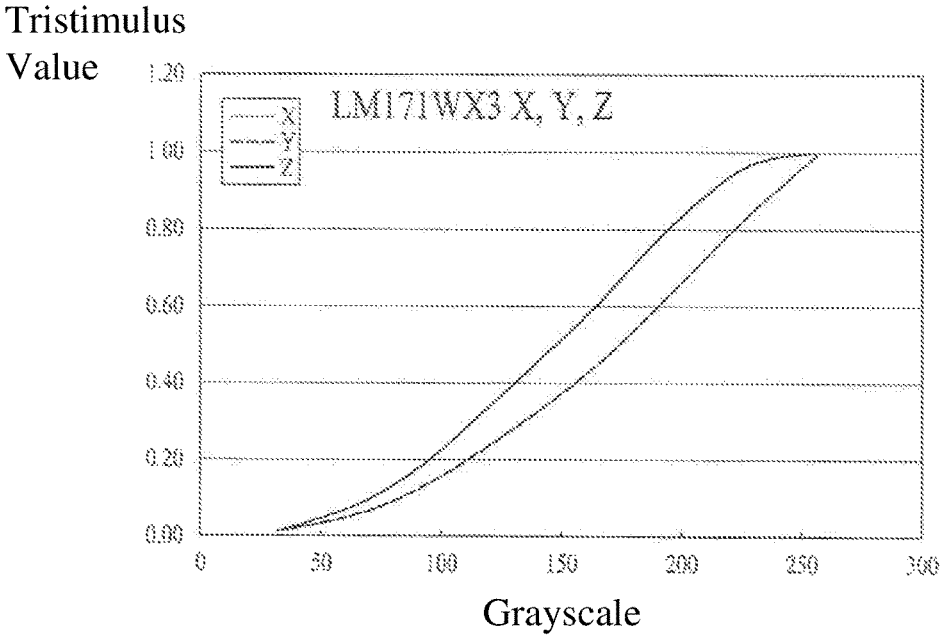

FIG. 2A illustrates graphs of tristimulus values X, Y, Z on a gradient of a general standard image RGB, sRGB, wherein it can be noted that slopes of the tristimulus values X, Y, Z are coincident. Opposite to this, FIG. 2B illustrates graphs of tristimulus values X, Y, Z on the gradient in the related art liquid crystal display device, wherein it can be noted that, though the slopes of the tristimulus values X, Y are coincident, the slope of the tristimulus value Z is high relatively in the related art liquid crystal display device. The relatively high Z graph slope thus makes white to appear bluish, and it can be noted that this relatively high Z graph slope is a cause of the color temperature variation and color feeling difference between the gradients as shown in FIG. 1.

Therefore, the present invention intends to reduce the color temperature variation and color feeling difference between the gradients by tuning the color temperature such that the Z graph slope becomes similar to the X and Y graph slopes. In order to tune the Z graph slope, i.e., the color temperature, the present invention tunes the blue gamma and the red gamma except the green gamma. Since brightness and the color feeling difference varies largely if the green gamma is tuned, it is preferable that the green gamma is not tuned at the time of the color temperature tuning. Moreover, from experiment, it is known that tuning of the red gamma after tuning of the blue gamma enables easy achievement of target values of the color temperature variation and color feeling difference between the gradients.

The present invention will use a method in which, after reducing the relatively great color temperature variation and color feeling difference between the gradients by tuning the blue gamma, the red gamma will be tuned to reduce the color temperature variation and color feeling difference between the gradients further, and the blue gamma will be tuned further finely to adjust remaining color temperature variation and color feeling difference, finely.

Reference will now be made in detail to the specific embodiments of the present invention, examples of which are illustrated in the accompanying drawings. Wherever possible, the same reference numbers will be used throughout the drawings to refer to the same or like parts.

Figure 3:
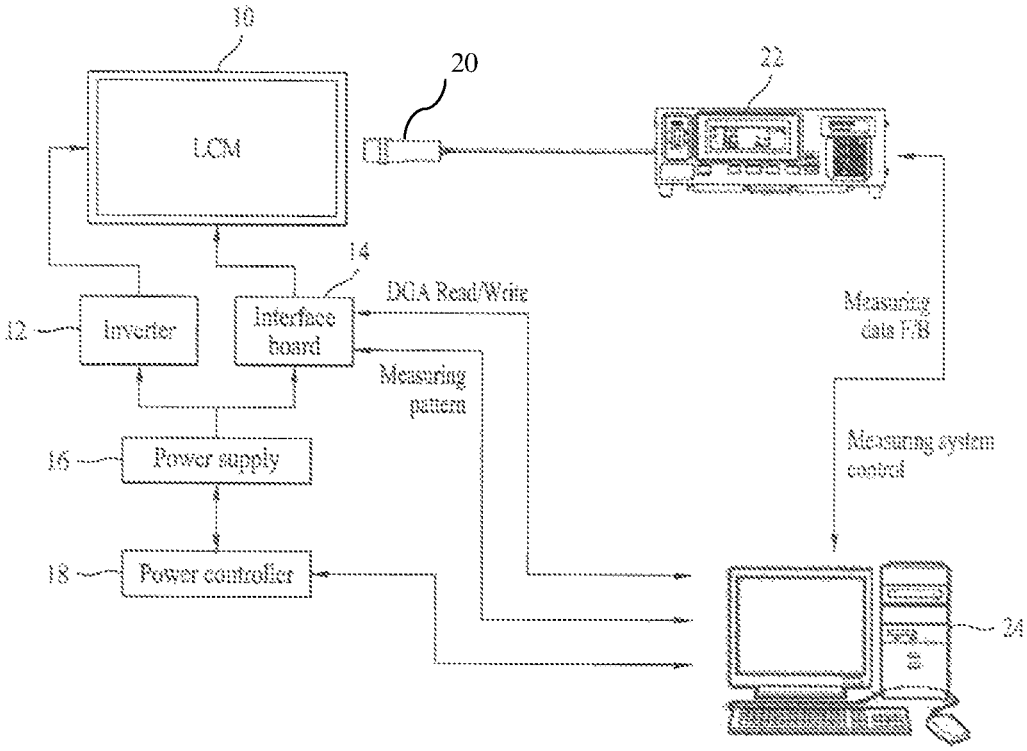
FIG. 3 illustrates a block diagram of a color temperature tuning device in a liquid crystal display device in accordance with a preferred embodiment of the present invention, schematically.
Figure 4:
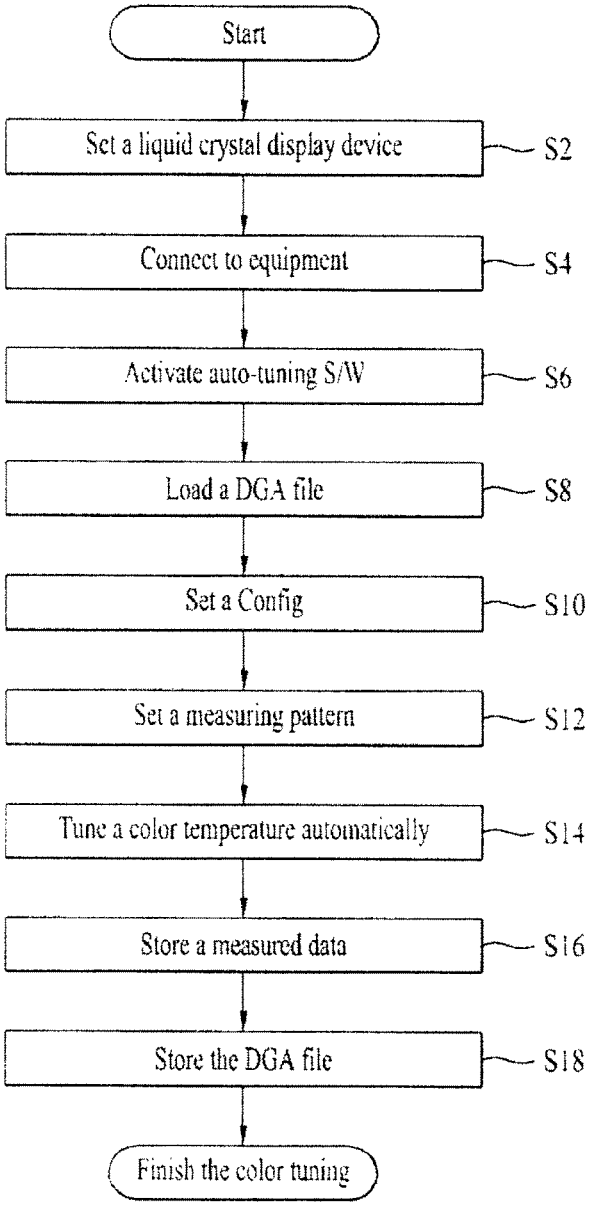
FIG. 4 illustrates a flow chart showing the steps of a method for tuning a color temperature in a liquid crystal display device in accordance with a preferred embodiment of the present invention.

FIG. 3 illustrates a block diagram of a color temperature tuning device in a liquid crystal display device in accordance with a preferred embodiment of the present invention schematically, and FIG. 4 illustrates a flow chart showing the steps of a method for tuning a color temperature in a liquid crystal display device in accordance with a preferred embodiment of the present invention.

Referring to FIG. 3, the color temperature tuning device in a liquid crystal display device 10 includes an inverter 12 and an interface board 14 connected to a liquid crystal display device 10 of which color temperature to be tuned, a power supplier 16 and a power controller 18 connected to the inverter 12 in series, a measuring system 22 connected to a camera 20, and a host computer 24 connected to the interface board 14, the power controller 18 and the measuring system 22.

The liquid crystal display device 10 includes a liquid crystal panel for displaying a picture, a panel driving circuit including a gate driver for driving gate lines of the liquid crystal panel and a data driver for driving data lines of the liquid crystal panel, a timing controller for controlling the panel driving circuit, and a backlight unit for supplying a light to the liquid crystal panel. The inverter 12 drives the backlight unit of the liquid crystal panel. The power supplier 16 supplies power to the inverter 12 and the interface board 14. The host computer 24 controls the power controller 18, and the power controller 18 controls power turn on/off of the power supplier 16 under the control of the host computer 24.

The host computer 24 reads a DGA look-up table (LUT) through the interface board 14 and an I2C (Inter-Integrated Circuit) bus, and tunes blue and red DGA values (i.e., DGA gradient levels) such that the color temperature variation and color feeling difference between the gradients meet a user's (or buyer's) requirement range, for correcting the Z graph slope to be similar to the X and Y graph slopes described with reference to FIG. 2.

Moreover, the host computer 24 supplies a measuring pattern used every time the color temperature tuning is made to the liquid crystal display device 10 through a DVI (Digital Visual Interface) and the interface board 14, for the liquid crystal display device 10 to display the measuring pattern from the host computer 24.

Every time the liquid crystal display device 10 displays the measuring pattern, the camera 20 takes a photography of the measuring pattern displayed on the liquid crystal display device 10, and the measuring system 22 analyzes an image of the photograph from the camera 20 to extract a measured data, such as brightness and chromaticity of the measuring pattern displayed on the liquid crystal display device 10 and supplies the same to the host computer 24. The host computer 24 controls the measuring system 22, and tunes the color temperature of the liquid crystal display device 10 while determining the measured data supplied from the measuring system 22. The host computer 24 tunes the blue gamma of the liquid crystal display device 10 to reduce the color temperature variation and color feeling difference between relatively great gradients, tunes the red gamma to reduce the color temperature variation and color feeling difference further, and makes fine tuning of the blue gamma to make fine adjustment of remaining color temperature variation and color feeling difference, thereby tuning the color temperature.

And, upon finishing the color temperature tuning, the host computer 24 writes a final DGA LUT including the blue and red DGA values tuned thus on a memory in the liquid crystal display device 10 through the I2C and the interface board 14.

Referring to FIG. 4, in a step 2 (S2), the liquid crystal display device 10 of which color temperature is to be tuned is set to the color tuning device shown in FIG. 3. The liquid crystal display device 10 is connected to an inverter and an interface board 14. Aging on the liquid crystal display device 10 connected to the inverter 12 and the interface board 14 can be performed about 30 minutes.

In a step 4 (S4), various units of the color tuning device shown in FIG. 3 are connected to one another. For an example, the power supplier 16 is connected to the power controller 18 through the serial interface RS232, and the power controller 18 is connected to the host computer 24 through a USG (Universal Serial Bus). The interface board 14 is connected to the host computer 24 through the DVI and the I2C. The measuring system 22 is connected to the host computer 24 through the serial interface RS232.

In a step 6 (S6), the host computer 24 puts an automatic color tuning program into operation, and in a step 8 (S8), the host computer 24 loads a DGA register map excel file.

In a step 10 (S10), the designer sets a Config. required for the color temperature tuning the user (buyer) desires to the host computer 24. The designer sets a correlated color temperature (CCT) target value and color temperature variation range the user (or buyer) desires, red and blue gammas, a variable ratio range of Δa* on the red DGA value (a gradient level of the DGA) and a variable ratio range of Δb* on the blue DGA value in an L*a*b* color space, allowable ranges of the Δa* and the Δb*, and intervals of the gradient tuning. In this instance, Δa* denotes a color feeling difference on reddish and greenish, and Δb* denotes a color feeling difference on bluish and yellowish.

For an example, the CCT target value the user (buyer) desires can be set to be 6500K, and a color temperature variation range of the CCT target value the user (buyer) desires can be set to be ±300K with reference to 6500K.

Figure 5:
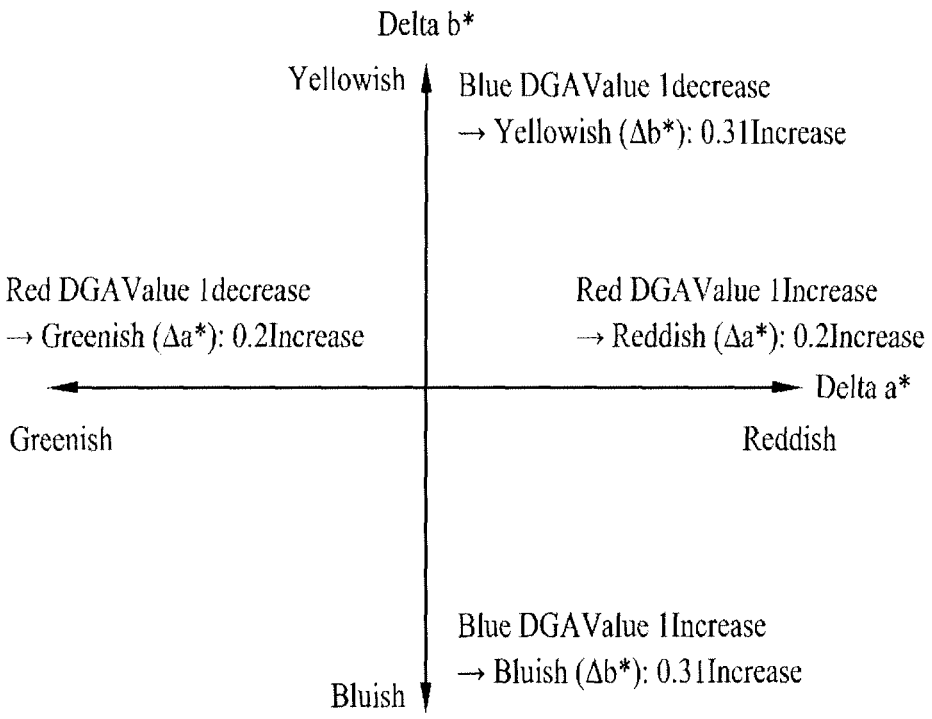
FIG. 5 illustrates coordinates showing a variation of color feeling differences according to blue and red DGA value adjustment to be applied to the present invention.

With regard to a ratio of the Δa* to the red DGA value determined by the designer, as shown in FIG. 5, as a result of analysis of a variable quantity of the Δa* according to the red DGA value, it can be known that the reddish Δa* increases by "0.2" every time the red DGA value increases by "1", and the greenish Δa* increases by "0.2" every time the red DGA value decreases by "1". From a result of this analysis, the ratio of Δa* to the red DGA value can be set to be "0.2". And, as a result of analysis of a variable quantity of the Δa* according to the blue DGA value, as shown in FIG. 5, it can be known that, in average, the bluish Δa* increases by "0.31" every time the blue DGA value increases by "1", and the yellowish Δb* increases by "0.31" every time the blue DGA value decreases by "1". From a result of this analysis, the ratio of Δb* to the blue DGA value can be set to be "0.31". Allowable ranges of Δa* and Δb* can be set to be "−3.0<a*<3.0" and "−3.0<b*<3.0" respectively. As shown in FIG. 5, this is because, since the user can not feel the color feeling difference if the Δa* and Δb* are within a range of "−3.0~3.0" respectively, the user determines that there is no color feeling difference in Wincolor.

The gradient tuning interval can be set to be "one gradient" or "two gradients".

In a step 12 (S12), at the time the designer measures the brightness and chromaticity of the liquid crystal display device 10 gradient by gradient with the measuring system 22, the designer sets a measuring pattern and a measuring gradient interval at the host computer 24. As the measuring pattern, red, green, blue and white patterns are set gradient by gradient. The measuring gradient interval, for setting a gradient interval for each of the red, green, blue and white measuring patterns, can be set, for an example, like "8 gradients" or "16 gradients".

In step 14 (S14), as the designer clicks an automatic tuning button on the host computer 24, the host computer 24 puts the color temperature tuning program into operation according to conditions set in the step 10 (S10) and the step 12 (S12) for tuning the color temperature automatically. The host computer 24 reads in an initial DGA LUT stored in a memory in the liquid crystal display device 10, displays the measuring pattern of each measuring gradient on the liquid crystal display device 10, and receives the brightness and chromaticity which the measuring system 22 extracts from a photograph of each of the measuring patterns displayed on the liquid crystal display device 10 taken by the camera 20 and analyzes the color temperature variation and color feeling difference of each gradient of the liquid crystal display device 10 with reference to the initial DGA LUT. And, the host computer 24 tunes the blue gamma and the red gamma in succession, makes the liquid crystal display device 10 to display the measuring pattern by using the DGA LUT tuned thus at every gamma tuning, and extracts color temperature and color feeling difference data on the liquid crystal display device 10 gamma tuned thus by using the measuring data from the measuring system 22 which measures the brightness and chromaticity of the liquid crystal display device 10 which displays the measuring pattern. Then, the host computer 24 determines whether the color temperature and color feeling difference data extracted from the data measured thus meet the requirement range of the user set in advance or not, and repeats the step of color temperature tuning by using the blue and red gamma adjustment until the requirement range is met. If the color temperature variation and color feeling difference between color gradients extracted from the measured data from the liquid crystal display device 10 meet the user requirement range, the host computer 24 finishes the blue and red gamma tuning. The color temperature tuning will be described in detail, later.

In a step 16 (S16), if the color temperature automatic tuning is finished in the step 14 (S14), as the host computer 24 stores the brightness and chromaticity data measured thus from the liquid crystal display device 10 at a report format, the designer can review the tristimulus value X, Y, Z graphs on the gradients of the liquid crystal display device 10 tuning of which is finished, the chromaticity of the Δa* and Δb*, and the color temperature graph on the gradients.

In a step 18 (S18), the measuring system 22 stores a final DGA LUT including the blue and red DGA values tuned in color temperature tuning in the step 14 (S14) therein, and the memory in the liquid crystal display device 10. Therefore, the final DGA LUT includes the green DGA value set initially, and the blue and red DGA values tuned in the step 14 (S14).

Figure 6:
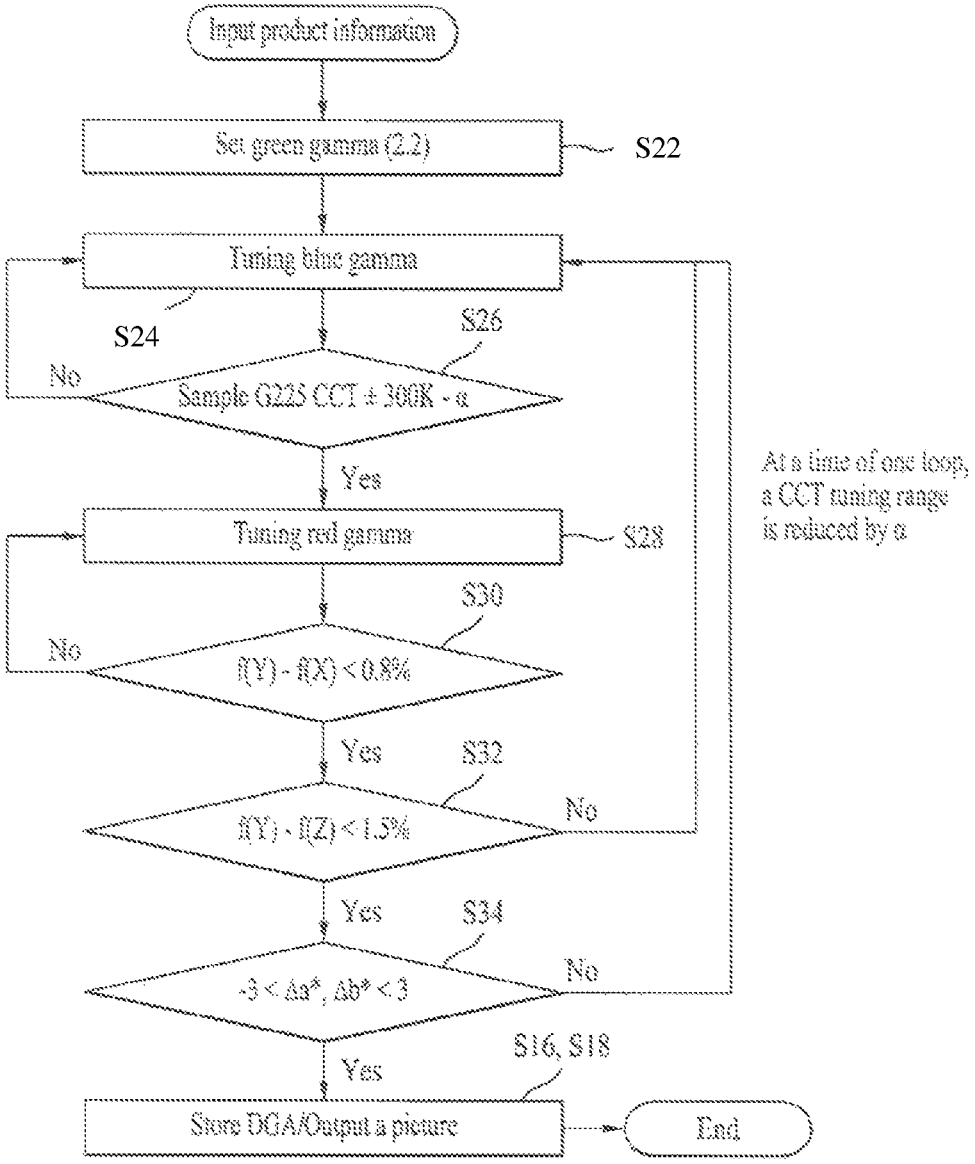
FIG. 6 illustrates a flow chart showing the steps of a color temperature tuning in FIG. 4, in detail.

FIG. 6 illustrates a flow chart showing the steps (S14) of a color temperature tuning in FIG. 4, in detail.

By providing product information on the liquid crystal display device 10 to the host computer 24 which is performing the automatic tuning program and clicking an automatic tuning button, the steps of automatic tuning shown in FIG. 6 is performed in succession. Before clicking the automatic tuning, the host computer 24 can read in the initial DGA LUT stored in the memory in the liquid crystal display device 10, display the measuring pattern of each measuring gradient on the liquid crystal display device 10, and analyze the color temperature variation and color feeling difference of each gradient of the liquid crystal display device 10 with reference to the initial DGA LUT by using the data measured thus with the camera 20 and the measuring system 22.

In the meantime, whenever the blue and gamma tuning to be described later are made, the host computer 24 displays the measured pattern from the liquid crystal display device 10 by using the DGA LUT tuned thus, and reviews the color temperature and the color feeling difference of the liquid crystal display device 10 gamma tuned thus by using the data measured thus with the camera 20 and the measuring system 22.

In this instance, the host computer 24 calculates the color temperature of each gradient by using the tristimulus values X, Y, Z converted from the measured data with the measuring system 22, and calculates color indices a* and b* by using the tristimulus values X, Y, Z with an equation 1 shown below.

$$a^*=500\times(f(X)-f(Y))$$

$$b^*=200\times(f(Y)-f(Z)) \qquad \text{Equation 1}$$

Where, functions f(X), f(Y), and f(Z) in equation 1 can be expressed with an equation 2, or equation 3 shown below.

$$f(X)=f\left(\frac{X}{X_{sRGB(255)}}\right)=\left(\frac{X}{X_{sRGB(255)}}\right)^{1/3},\quad \text{if}\left(\frac{X}{X_{sRGB(255)}}\right)>0.00885$$
$$f(Y)=f\left(\frac{Y}{Y_{sRGB(255)}}\right)=\left(\frac{Y}{Y_{sRGB(255)}}\right)^{1/3},\quad \text{if}\left(\frac{Y}{Y_{sRGB(255)}}\right)>0.00885$$
$$f(Z)=f\left(\frac{Z}{Z_{sRGB(255)}}\right)=\left(\frac{Z}{Z_{sRGB(255)}}\right)^{1/3},\quad \text{if}\left(\frac{Z}{Z_{sRGB(255)}}\right)>0.00885$$

Equation 2

$$f(X)=f\left(\frac{X}{X_{sRGB(255)}}\right)=7.787\left(\frac{X}{X_{sRGB(255)}}\right)+\frac{16}{116},\quad \text{if}\left(\frac{X}{X_{sRGB(255)}}\right)\le 0.00885$$
$$f(Y)=f\left(\frac{Y}{Y_{sRGB(255)}}\right)=7.787\left(\frac{Y}{Y_{sRGB(255)}}\right)+\frac{16}{116},\quad \text{if}\left(\frac{Y}{Y_{sRGB(255)}}\right)\le 0.00885$$
$$f(Z)=f\left(\frac{Z}{Z_{sRGB(255)}}\right)=7.787\left(\frac{Z}{Z_{zRGB(255)}}\right)+\frac{16}{116},\quad \text{if}\left(\frac{Z}{Z_{sRGB(255)}}\right)\le 0.00885$$

Equation 3

In the equations 2 and 3, X, Y, and Z denote the tristimulus values from the liquid crystal display device 10. $X_{sRGB\ (255)}$, $Y_{sRGB\ (255)}$, and $Z_{sRGB\ (255)}$ denote white tristimulus values in a standard image sRGB, which are preset values.

Then, the host computer 24 calculates Δa* and Δb* which denote the color feeling differences by using the color indices a* and b* calculated from the equation 1 and color indices sRGB a* and sRGB b* of the preset standard image with an equation 4 below.

$$\Delta a^*=a^*-sRGBa^*$$
$$\Delta b^*=b^*-sRGBb^*$$

Equation 4

Whenever each of the blue and red gamma tuning is made, the host computer 24 determines whether the color temperature variation and the color feeling difference between the gradients of the liquid crystal display device 10 having the blue or/and red gamma thereof tuned by using the f(X) function, the f(Y) function, the f(Z) function, Δa* and Δb* with equations 1 to 4 from the measured tristimulus values X, Y and Z of the liquid crystal display device 10 meet the user requirement range or not, and repeat the blue and red gamma tuning until the requirement range is met.

In a step 22 (S22), the host computer 24 sets a green gamma with reference to the initial DGA LUT the host computer 24 reads in from the liquid crystal display device 10. For an example, the green gamma is set to be 2.2 gamma.

In a step 24 (S24), the host computer 24 tunes the blue gamma. The host computer 24 tunes the blue DGA value by the gradient tuning interval (one gradient or two gradients and so on) set in the step 10 (S10). Though a number of DGA gradient levels used in the liquid crystal display device 10 is 256 (0 Gradient~255 gradient), a number of the DGA gradient levels adjustable in the gamma tuning are about 505 (0 gradient~504 gradient) which are greater than the 256 gradients. Therefore, the host computer 24 adjusts the blue DGA gradient levels according to the preset gradient tuning intervals within the range of the 505 gradient levels, selects the 256 blue DGA gradient levels adjusted thus, and maps 256 gradient blue DGA values for tuning the blue DGA values.

In a step 26 (S26), the host computer 24 determines whether the color temperature of each gradient of the liquid crystal display device 10 meets the preset first color temperature range "a standard white correlated color temperature (sample G255 CCT)±a color temperature variation 300K−α" (Where, α is a color temperature reduction in one time of tuning) or not.

In detail, the host computer 24 writes the DGA LUT including the blue DGA value tuned in the step 24 (S24) on the liquid crystal display device 10, and supplies the measured pattern of each measured gradient to the liquid crystal display device 10. According to this, the liquid crystal display device 10 displays the measured pattern by using the DGA LUT blue gamma tuned thus. The host computer 24 detects the color temperature of each gradient of the liquid crystal display device 10 blue gamma tuned thus by using a data measured by the measuring system 22 from a photograph of each measured pattern displayed on the liquid crystal display device 10 taken by the camera 20. Then, the host computer 24 determines whether the color temperature of each gradient of the liquid crystal display device 10 detected thus meets the preset first color temperature range (A standard white correlated color temperature±a color temperature variation−α) (For an example, 6500K±300K−α) or not.

In this instance, if the color temperature of each gradient of the liquid crystal display device 10 blue gamma tuned thus fails to meet the preset color temperature range, the host computer 24 keeps the blue gamma tuning while repeating the step 24 (S24) and the step 26 (S26) until the color temperature range is met. With such blue gamma tuning of the step 24 (S24) and the step 26 (S26), a relatively great color temperature variation between gradients can be reduced. For an example, an initial color temperature range of 6000K~9500K shown in FIG. 1 of the liquid crystal display device 10 can be reduced to a range of 6000K~7000K shown in FIG. 7C by the blue gamma tuning using the step 24 (S24) and the step 26 (S26). And then, the color temperature range of 6000K~7000K may be further reduced to be below ±300K with reference to the reference color temperature 6500K shown in FIG. 7C by after-mentioned steps, including at least steps 28 and 30 (S24, S26). Here, it is excluded a color temperature range of below 31 gradients which does not give substantial influence to the color feeling difference the user feels.

In the meantime, if the color temperature of each gradient of the liquid crystal display device 10 blue gamma tuned thus in the step 26 (S26) meets the first color temperature range, the host computer 24 proceeds to a step 28 (S28) to tune a red gamma. The host computer 24 tunes the red DGA value by the gradient tuning interval (one gradient or two gradients and the like) set in the step 10 (S10). A red DGA value tuning method is identical to the blue gamma tuning method in the step 22 (S22).

In a step 30 (S30), the host computer 24 determines whether a difference "f(Y)−f(X)" of a Y stimulus function f(Y) value and an X stimulus function f(X) value detected from the measured data of the liquid crystal display device 10 which displays the measured pattern by using the DGA LUT including the blue DGA value tuned in the step 24 (S24) and the step 26 (S26) and the red DGA value tuned in the step 28 (S28) meets a preset first color temperature variation range (below 0.8%) like an equation 5 below or not.

$$f(Y)-f(X)<0.8\% \quad \text{Equation 5}$$

In the equation 5, the Y stimulus function f(Y) value and the X stimulus function f(X) value are calculated by equation 2 or 3. The host computer 24 keeps tuning the red gamma repeating the step 28 (S28) and the step 30 (S30) until the "f(Y)−f(X)" becomes below a first range (0.8%) if the difference "f(Y)−f(X)" of the Y stimulus function f(Y) value and the X stimulus function f(X) value extracted from the measured data of the liquid crystal display device 10 blue and red gamma tuned thus is greater than a first color temperature variation range (below 0.8%).

Opposite to this, the host computer 24 proceeds to a next step 32 (S32) if the difference of the Y stimulus function f(Y) value and the X stimulus function f(X) value extracted from the measured data of the liquid crystal display device 10 blue and red gamma tuned thus is smaller than the color temperature variation range (below 0.8%).

In the step 32 (S32), the host computer 24 determines whether the difference "f(Y)−f(Z)" of the Y stimulus function f(Y) value and the Z stimulus function f(Z) value extracted from the measured data of the liquid crystal display device 10 blue and red gamma tuned thus meet a preset second color temperature variation range (below 1.5%) or not as shown in an equation below.

$$f(Y)-f(X)<0.8\% \quad \text{Equation 6}$$

In the equation 6, the Y stimulus function f(Y) value and the Z stimulus function f(Z) value are calculated by equation 2 or 3. The host computer 24 performs the blue gamma tuning step and the red gamma tuning step more in succession repeating the step 24 (S24) and the step 32 (S32) until the "f(Y)−f(Z)" becomes below a second color temperature range (1.5%) if a difference "f(Y)−f(Z)" of the Y stimulus function f(Y) value and a Z stimulus function f(Z) value extracted from the measured data from the liquid crystal display device 10 blue and red gamma tuned thus is greater than the second color temperature variation range (below 1.5%).

Opposite to this, the host computer 24 proceeds to a next step 34 (S34) if the difference of the Y stimulus function f(Y) value and the Z stimulus function f(Z) value extracted from the measured data from the liquid crystal display device 10 blue and red gamma tuned thus is smaller than the second color temperature variation range (below 1.5%).

In the step 34 (S34), the host computer 24 determines whether the color feeling differences Δa* and Δb* detected from the measured data from the liquid crystal display device 10 which displays the measured pattern by using the DGA LUT including the blue DGA value tuned in the step 24 (S24) and the step 26 (S26) and the red DGA value tuned in the step 28 (S28) to the step 32 (S32) meet the following color feeling difference or not.

$$-3.0<\Delta a^*<3.0$$

$$-3.0<\Delta b^*<3.0 \quad \text{Equation 7}$$

The color feeling differences Δa* and Δb* in equation 7 are calculated by using the equations 1 to 4. The host computer 24 keeps tuning the blue and red gammas repeating the step 24 (S24) to 34 (S24) until each of the color feeling differences Δa* and Δb* meets the color difference range of −3.0~3.0 if each of the color feeling differences Δa* and Δb* detected from the measured data from the liquid crystal display device 10 having the blue and red gamma tuned thus does not meet the color difference range of −3.0~3.0.

In the meantime, the host computer 24 finishes the gamma tuning if each of the color feeling differences Δa* and Δb* detected from the measured data of the liquid crystal display device 10 having the blue and red gamma tuned thus meets the color feeling difference range of −3.0~3.0, proceeds to the step 16 (S16) in FIG. 4 described before, stores the measured data, proceeds to the step 18 (S18), and writes a final DGA LUT including the blue and red DGA values tuned thus on a memory in the liquid crystal display device 10 to finish tuning.

Eventually, the method for tuning a color temperature in a digital display device of the present invention can reduce the color temperature variation between gradients to be below ±300K with reference to the reference color temperature 65000K, and the color feeling difference Δa* or Δb* to be within a range of −3.0~3.0.

FIGS. 7A~7D illustrate graphs showing a relation of a color temperature on each gradient and a relation of a color feeling on each gradient in a related art liquid crystal display device and a liquid crystal display device of the present invention, respectively.

Figure 7A:
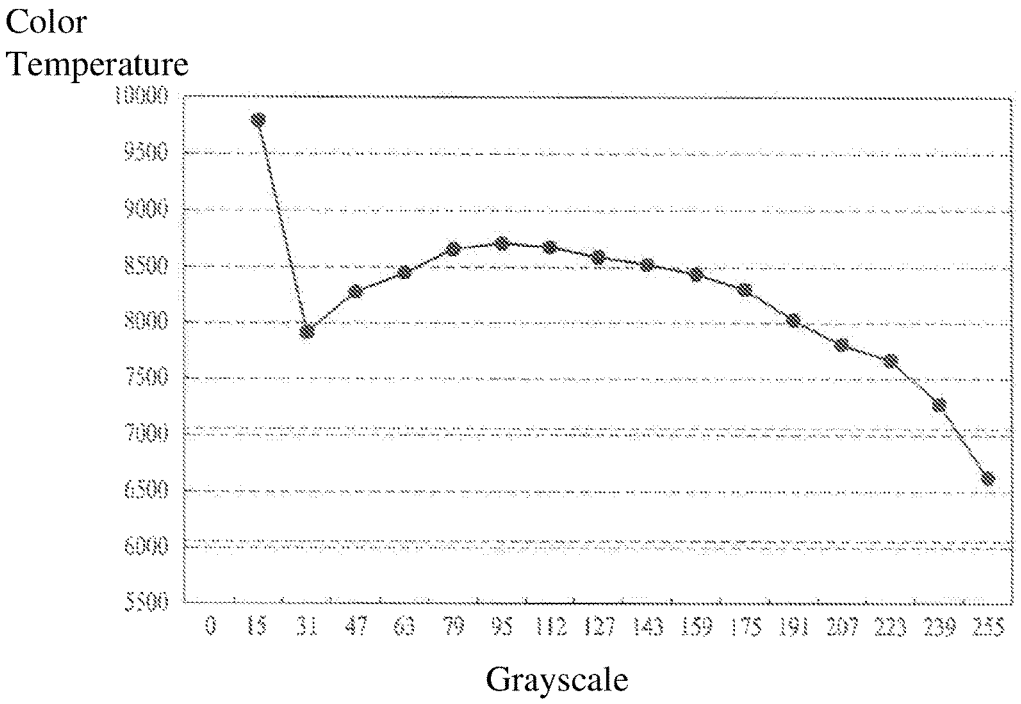
FIG. 7A RELATED ART
FIGS. 7A~7D illustrate graphs showing a relation of a color temperature on each gradient and a relation of a color feeling on each gradient in a related art liquid crystal display device and a liquid crystal display device of the present invention, respectively.
Figure 7B:
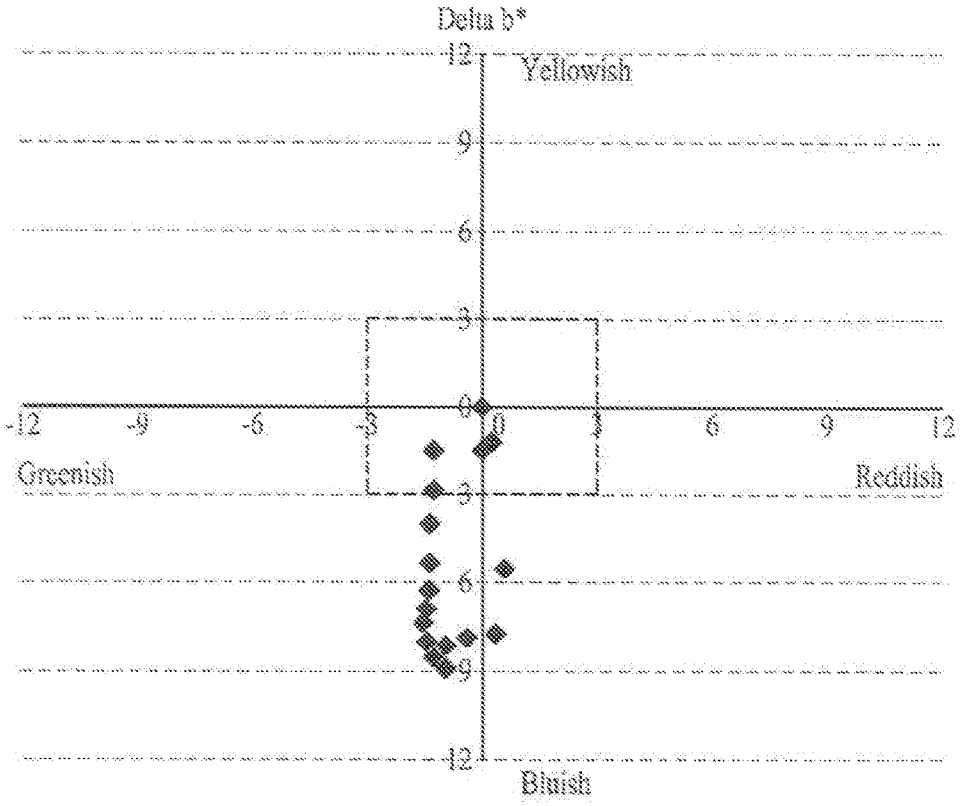
FIG. 7B RELATED ART

Referring to FIG. 7A, it can be known that the color temperature of each gradient measured at the liquid crystal display device 10 having the related art gamma tuning applied thereto varies in a range of 65000K~9000K widely, even if a small gradient range below 31 gradients which does not give substantial influence to the color feeling difference the user feels, causing the Δb* out of the allowable color feeling difference range of −3.0~3.0 to show a color feeling difference in which white becomes bluish as shown in FIG. 7B.

Figure 7C:
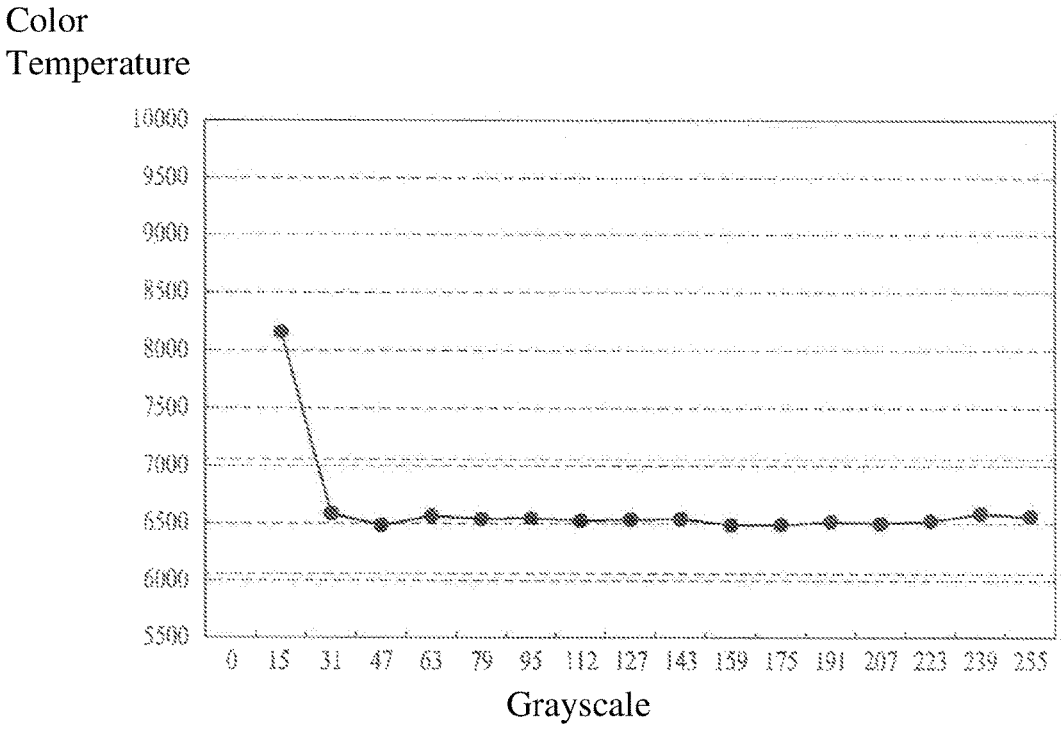
Figure 7D:
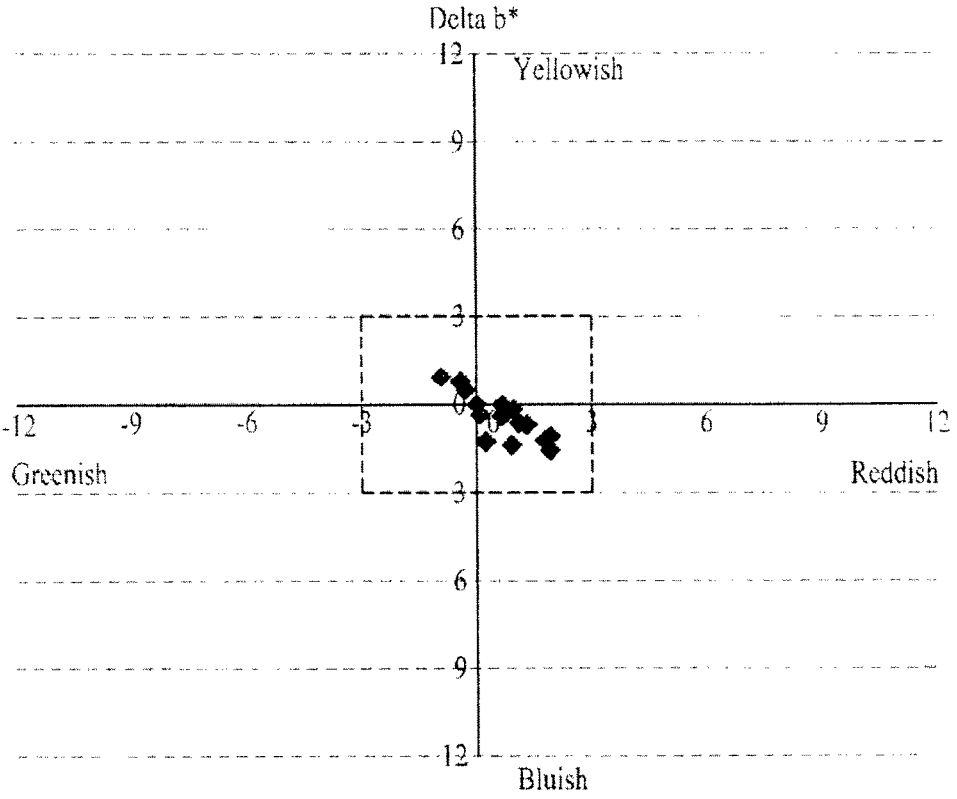

Opposite to this, referring to FIG. 7C, it can be known that the color temperature of each gradient measured at the liquid crystal display device having the gamma tuning of the present invention applied thereto is reduced to be below ±70K to be almost similar to 65000K, in a case a small gradient range below 31 gradients which does not give substantial influence to the color feeling difference the user feels, making the user not to feel the color difference as the Δa* or Δb* is positioned within the allowable color feeling difference range of −3.0~3.0 as shown in FIG. 7D.

As has been described, the method and device for tuning a color temperature in a digital display device in accordance with the present invention have the following advantages.

The color temperature variation between gradients and the color feeling difference of each gradient can be minimized by tuning the blue and red gammas in succession according to a preset condition, determining a result of the tuning from the measured data from the liquid crystal display device tuned thus, and repeating a blue and red gamma tuning step and a tuning result determining step until a user requirement condition is met.

In the meantime, though the method and device for tuning a color temperature in a digital display device of the present invention have been described taking a case in which the method and device for tuning a color temperature in a digital display device are applied to a liquid crystal display device, it can be known to the persons skilled in this field of art that the present invention is applicable to different digital display devices, such as an OLED display device, and plasma display panel PDP, easily.

What is claimed is:

1. A method for tuning a color temperature in a liquid crystal display device comprising the steps of:

in a first step, setting a green gamma to a preset green gamma value;

in a second step, tuning a blue gamma in a gamma look-up table having red, green, and blue gammas stored in the liquid crystal display device until color temperatures of a plurality of gradients, converted from measured data of brightness and chromaticity of a measuring pattern photograph from the liquid crystal display device having the tuned blue gamma, meet a preset color temperature range;

in a third step, tuning the red gamma until f(Y)−f(X) meets a first preset color temperature variation range of below 0.8%, f(Y)−f(X) being a difference between a Y tristimulus value function f(Y) value and an X tristimulus value function f(X), which are calculated from the color temperatures of the plurality of gradients, converted from the measured data from the liquid crystal display device, and preset white tristimulus values in a standard image sRGB;

in a fourth step, determining whether f(Y)−f(Z) meets a second preset color temperature variation range of below 1.5%, and if f(Y)−f(Z) does not meet the second preset color temperature variation range, sequentially repeating the second and third steps until f(Y)−f(Z) meets the second preset color temperature variation range, f(Y)−f(Z) being a difference between the Y tristimulus value function f(Y) value and an Z tristimulus value function f(Z), which are calculated from the color temperatures of the plurality of gradients, converted from the measured data from the liquid crystal display device, and the preset white tristimulus values in a standard image sRGB;

in a fifth step, determining whether color feeling differences Δa* and Δb* each meet a color feeling difference range of greater than −3.0 and less than 3.0, and if the color feeling differences Δa* and Δb* do not each meet the color feeling difference range, sequentially repeating the second, third, and fourth steps until the color feeling differences Δa* and Δb* each meet the color feeling difference range, wherein the color feeling differences Δa* and Δb* are color feeling difference values between the plurality of gradients determined as a function of the preset white tristimulus values in a standard image sRGB, and f(X) and f(Y), and f(Y) and f(Z), respectively; and finishing the blue and red gamma tuning if the color feeling difference range is met, and storing a final gamma look-up table having the tuned blue gamma and the tuned red gamma and the green gamma in the liquid crystal display device wherein the color temperature tuning range for each of the plurality of gradients is ±70 K from a set target correlated temperature.

2. The method as claimed in claim 1, wherein the preset color temperature range is a standard white correlated color temperature±a color temperature variation 300K-a, where 'a' is a color temperature reduced in one time of tuning.

3. The method of claim 1, wherein the color feeling differences Δa* and Δb* are calculated using equation 4 and color indices a* and b*, and the color indices a* and b* are calculated using equation 1, wherein equation 1 is:

$$a^*=500\times(f(X)-f(Y))$$

$$b^*=200\times(f(Y)-f(Z)),$$

wherein equation 4 is:

$$\Delta a^*=a^*-sRGBa^*$$

$$\Delta b^*=b^*-sRGBb^*.$$

4. The method of claim 1, wherein the set target correlated temperature is 6500 K.

5. A device for tuning a color temperature in a digital image display device comprising:

a liquid crystal display device for displaying a measuring pattern from an outside by using a gamma look-up table having red, green, and blue gammas stored in a memory in the liquid crystal display device;

a measuring system for taking an image of the measuring pattern displayed on the liquid crystal display device and extracting a measured data; and a host computer for, while reading the gamma look-up table from the liquid crystal display device, setting a green gamma to a preset green gamma value, and tuning the blue gamma and the red gamma in succession without tuning the green gamma, controlling the liquid crystal display device to display the measured pattern by using the tuned blue and the tuned red gammas, detecting color temperatures of a plurality of gradients and color feeling differences of the liquid crystal display device by using the measured data extracted from the measuring system, determining whether each of the color temperatures and the color feeling differences detected thus meets a preset range or not, finishing the blue and the red gamma tuning if the range is met, and storing a final gamma look-up table having the blue and the red gammas tuned thus and the green gamma in the liquid crystal display device, wherein the host computer while in a first step tuning the blue gamma in the gamma look-up table, determines whether the color temperatures measured from the liquid crystal display device having the tuned blue gamma meet a preset color temperature range or not, to keep tuning the blue gamma until the preset color temperature range is met;

if the measured color temperature meets the preset color temperature range, while in a second step tuning the red gamma, determines whether f(Y)−f(X) meets a first preset color temperature variation range of below 0.8% or not, to sequentially repeat the first and second steps until the first preset color temperature variation range is met, the first preset color temperature variation range being a difference between a Y tristimulus value function f(Y) value and an X tristimulus value function f(X), which are calculated from the color temperatures of the plurality of gradients detected using the measured data from the liquid crystal display device and preset white tristimulus values in a standard image sRGB;

if the first preset color temperature variation range is met, determines M a third step whether f(Y)−f(Z) meets a second preset color temperature variation range or below 1.5% or not, to sequentially repeat the first, second and third steps until second preset color temperature variation range is met, the second preset color temperature variation range being a difference between the Y tristimulus value function f(Y) value and an Z tristimulus value function f(Z), which are calculated from the color temperatures of the plurality of gradients using the measured data from the liquid crystal display device and the preset white tristimulus values in a standard image sRGB;

if the second preset color temperature variation range is met, determines in a fourth step whether color feeling differences Δa* and Δb* each meet a color feeling difference range of greater than −3.0 and less than 3.0, to sequentially repeat the first, second, third and fourth steps until the color feeling difference range is met, wherein the color feeling differences Δa* and Δb* are color feeling difference values between the plurality of gradients determined as a function of the preset white tristimulus values in a standard image sRGB, and f(X) and f(Y), and f(Y) and f(Z), respectively; and finishes the blue and the red gamma tuning if the color feeling difference range is met, wherein the color temperature tuning range for each of the plurality of gradients is ±70 K from a set target correlated temperature.

6. The device as claimed in claim 5, wherein the preset color temperature range is a standard white correlated color temperature±a color temperature variation 300K-a, where 'a' is a color temperature reduced in one time of tuning.

7. The device of claim 5, wherein the color feeling differences Δa* and Δb* are calculated using equation 4 and color indices a* and b*, and the color indices a* and b* are calculated using equation 1, wherein equation 1 is:

$$a^*=500\times(f(X)-f(Y))$$

$$b^*=200\times(f(Y)-f(Z)),$$

wherein equation 4 is:

$$\Delta a^*=a^*-sRGBa^*$$

$$\Delta b^*=b^*-sRGBb^*.$$

8. The device of claim 5, wherein the set target correlated temperature is 6500 K.

* * * * *